US011976546B2

(12) United States Patent
Fouda et al.

(10) Patent No.: US 11,976,546 B2
(45) **Date of Patent: *May 7, 2024**

(54) DEEP LEARNING METHODS FOR WELLBORE PIPE INSPECTION

(71) Applicant: Halliburton Energy Services, Inc., Houston, TX (US)

(72) Inventors: Ahmed Elsayed Fouda, Spring, TX (US); Junwen Dai, The Woodlands, TX (US); Li Pan, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 216 days.

This patent is subject to a terminal disclaimer.

(21) Appl. No.: 17/114,591

(22) Filed: Dec. 8, 2020

(65) Prior Publication Data

US 2022/0178244 A1 Jun. 9, 2022

(51) Int. Cl.
*E21B 47/002* (2012.01)

(52) U.S. Cl.
CPC ..... *E21B 47/0025* (2020.05); *E21B 2200/22* (2020.05)

(58) Field of Classification Search
CPC ..... E21B 47/0025; E21B 2200/22; E21B 2200/20; E21B 47/006
See application file for complete search history.

(56) References Cited

U.S. PATENT DOCUMENTS 6,344,741 B1 2/2002 Giguere et al.
7,960,969 B2 6/2011 Mouget et al.
(Continued)

FOREIGN PATENT DOCUMENTS

CN 105787508 B * 2/2019 ..... G06K 9/4652
GB 2599911 A * 4/2022 ..... G06N 3/04
(Continued)

OTHER PUBLICATIONS

R. Oullette and et al, "Genetic Algorithm Optimization of a Convolutional1 Neural Network for Autonomous Crack Detection", Proceedings of the congress on evolutionary computation, Portland, OR, Jun. 19-23, 2004, pp. 516-521, 2004 IEEE (Year: 2004).*
(Continued)

*Primary Examiner* — Douglas Kay
(74) *Attorney, Agent, or Firm* — DeLizio, Peacock, Lewin & Guerra, LLP

(57) ABSTRACT

Methods and systems for inspecting the integrity of multiple nested tubulars are included herein. A method for inspecting the integrity of multiple nested tubulars can comprise conveying an electromagnetic pipe inspection tool inside the innermost tubular of the multiple nested tubulars; taking measurements of the multiple nested tubulars with the electromagnetic pipe inspection tool; arranging the measurements into a response image representative of the tool response to the tubular integrity properties of the multiple nested tubulars; and feeding the response image to a pre-trained deep neural network (DNN) to produce a processed image, wherein the DNN comprises at least one convolutional layer, and wherein the processed image comprises a representation of the tubular integrity property of each individual tubular of the multiple nested tubulars.

20 Claims, 10 Drawing Sheets

(56) References Cited

U.S. PATENT DOCUMENTS

| | | | | |
|---|---|---|---|---|
| 9,310,338 | B2 | 4/2016 | Yarbro et al. | |
| 9,512,712 | B2 * | 12/2016 | Donderici | E21B 47/006 |
| 9,715,034 | B2 | 7/2017 | Omeragic et al. | |
| 9,983,173 | B2 | 5/2018 | Aslanyan et al. | |
| 10,234,591 | B2 | 3/2019 | Wu et al. | |
| 10,260,854 | B2 | 4/2019 | Zhang | |
| 10,502,044 | B2 | 12/2019 | Fouda et al. | |
| 10,533,411 | B2 | 1/2020 | Fouda et al. | |
| 10,641,594 | B2 | 5/2020 | San Martin et al. | |
| 10,662,758 | B2 | 5/2020 | Donderici et al. | |
| 10,670,563 | B2 | 6/2020 | Fouda et al. | |
| 10,725,194 | B2 | 7/2020 | Fouda et al. | |
| 10,823,873 | B2 | 11/2020 | Fouda et al. | |
| 11,353,617 | B1 * | 6/2022 | Fouda | G01V 1/50 |
| 2016/0035078 | A1 * | 2/2016 | Lin | G06K 9/6255 382/157 |
| 2016/0063359 | A1 * | 3/2016 | Szegedy | G06N 3/0454 382/158 |
| 2016/0102500 | A1 * | 4/2016 | Donderici | E21B 41/0092 175/45 |
| 2016/0160629 | A1 * | 6/2016 | Donderici | G01N 27/9046 324/238 |
| 2016/0161627 | A1 * | 6/2016 | Khalaj Amineh | E21B 47/085 702/6 |
| 2017/0191361 | A1 * | 7/2017 | Khalaj Amineh | E21B 47/085 |
| 2017/0285579 | A1 * | 10/2017 | Kitazawa | G01N 21/64 |
| 2018/0106763 | A1 | 4/2018 | Fouda et al. | |
| 2019/0129057 | A1 * | 5/2019 | Fanini | G01V 3/38 |
| 2019/0147125 | A1 * | 5/2019 | Yu | G06N 3/0445 703/10 |
| 2019/0162870 | A1 | 5/2019 | San Martin et al. | |
| 2019/0218904 | A1 * | 7/2019 | Fouda | G01N 27/908 |
| 2019/0390544 | A1 | 12/2019 | Dai et al. | |
| 2020/0081148 | A1 | 3/2020 | Capoglu et al. | |
| 2020/0200940 | A1 | 6/2020 | Fouda et al. | |
| 2020/0271818 | A1 | 8/2020 | Fouda et al. | |
| 2022/0065094 | A1 * | 3/2022 | Hill, III | G06N 3/02 |
| 2022/0179117 | A1 * | 6/2022 | Fouda | E21B 47/0025 |

FOREIGN PATENT DOCUMENTS

| | | | | |
|---|---|---|---|---|
| KR | 20210010194 | A * | 7/2019 | |
| WO | 2015157270 | A1 | 10/2015 | |
| WO | WO-2018236495 | A1 * | 12/2018 | E21B 47/00 |
| WO | 2019168698 | A1 | 9/2019 | |
| WO | 2020005194 | A1 | 1/2020 | |
| WO | 2020205085 | A1 | 10/2020 | |

OTHER PUBLICATIONS

S. Iyer and S. K. Sinha, "Segmentation of Pipe Images for Crack Detection in Buried Sewers", Computer-Aided Civil and Infrastructure Engineering 21 (2006) 395-410 (Year: 2006).*

B. T. Bastian and et al, "Visual inspection and characterization of external corrosion in pipelines using deep neural network", NDT & E International, vol. 107, Oct. 2019, 102134, Elsevier. https://doi.org/10.1016/j.ndteint.2019.102134 (Year: 2019).*

San Martin, et al., "New High-Definition Frequency Tool for Tubing and Multiple Casing Corrosion Detection", Society of Petroleum Engineers, 2017, 14 pages (Year: 2017).*

Brill, "Electromagnetic Casing Inspection Tool for Corrosion Evaluation", International Petroleum Technology conference, 2011, 14 pages (Year: 2011).*

M. T. McCann, K. H. Jin and M. Unser, "Convolutional Neural Networks for Inverse Problems in Imaging: A Review," in IEEE Signal Processing Magazine, vol. 34, No. 6, pp. 85-95, Nov. 2017, doi: 10.1109/MSP.2017.2739299 (Year: 2017).*

PCT Application No. PCT/US2020/063874, International Search Report, dated Sep. 1, 2021, 3 pages.

PCT Application No. PCT/US2020/063874, Written Opinion, dated Sep. 1, 2021, 5 pages.

"Acoustic Conformance Xaminer® (ACX™) Tool Identifies Low-Rate Gas Leak in Production Casing", Halliburton Case Study, 2016, 2 pages.

"Electromagnetic Pipe Xaminer® V (EPX™ V) Tool", Halliburton Wireline & Perforating, 2019, 2 pages.

Brill, "Electromagnetic Casing Inspection Tool for Corrosion Evaluation", International Petroleum Technology Conference, 2011, 14 pages.

Brownlee, "A Gentle Introduction to k-fold Cross-Validation", Machine Learning Mastery, Retrieved from the Internet <URL: https://machinelearningmastery.com/k-fold-cross-validation/>, 2018, 8 Pages.

Buduma, et al., "Fundamentals of Deep Learning Designing Next-Generation Machine Intelligence Algorithms", O'Reilly Media; 1st edition (Jul. 4, 2017), 288 pages.

Dutta, et al., "Analysis and Interpretation of Multi-Barrier Transient Electromagnetic Measurements", SPWLA 61st Annual Logging Symposium, 2020, 13 pages.

Rourke, et al., "Multi-Tubular Corrosion Inspection Using a Pulsed Eddy Current Logging Tool", International Petroleum Technology Conference, 2013, 6 pages.

San Martin, et al., "New High-Definition Frequency Tool for Tubing and Multiple Casing Corrosion Detection", Society of Petroleum Engineers, 2017, 14 pages.

* cited by examiner

DEEP LEARNING METHODS FOR WELLBORE PIPE INSPECTION

TECHNICAL FIELD

The disclosure generally relates to the field of surveying boreholes (i.e. wellbores), and particularly inspecting tubulars disposed therein.

BACKGROUND

Most, if not all, oil and gas wells, one or more tubulars are disposed in a wellbore of the well. In many instances, multiple tubulars are nested circumferentially, i.e. with smaller diameter tubulars disposed within larger diameter wellbores. Over time these tubulars experience corrosion due to many causes, including electrochemical, chemical, or mechanical origins. Early detection of metal loss due can be very valuable to oil and gas wells management, as failure detection of metal loss may lead to expensive remedial measurements and intervention in production wells.

BRIEF DESCRIPTION OF THE DRAWINGS

Embodiments of the disclosure may be better understood by referencing the accompanying drawings.

DESCRIPTION

The following detailed description refers to the accompanying drawings that show, by way of illustration and not limitation, various embodiments. These embodiments are described in sufficient detail to enable those skilled in the art to practice these and other embodiments. Other embodiments may be utilized, and structural, mechanical, logical, and electrical changes may be made to these embodiments. The various embodiments are not necessarily mutually exclusive, as some embodiments can be combined with one or more other embodiments to form new embodiments. The following detailed description is, therefore, not to be taken in a limiting sense.

In inspecting downhole tubulars (i.e. pipes) for metal loss due to corrosion, one or more measurements can be taken using an electromagnetic pipe inspection tool. The raw measurements can be arranged into a response image representative of a tool response to the tubular integrity property of the tubulars. The tubular integrity property can include cross-sectional thickness, a magnetic permeability, an electrical conductivity, or a combination thereof. The raw measurements can be taken with a frequency-domain tool or a time domain tool and can be omnidirectional or directional (i.e. azimuthal). Instead of applying an inversion to the raw measurements, the response image can be fed directly to a pre-trained deep neural network (DNN) having at least one convolutional layer to produce a processed image representative of an tubular integrity property of each individual tubular of the multiple nested tubulars. Avoiding inversion can improve accuracy (e.g. inversions are non-unique by nature leading to multiple solutions), can prevent artifacts (e.g. due compromising accuracy for computation speed), can limit sensitivity to the measurements (e.g. spikes due to a noisy channel), and can save time (e.g. when as an inversion applied point by point to preserve accuracy). By pre-training a DNN having at least one convolutional layer, the DNN can quickly provide an accurate processed image in a much shorter time than most inversions. Further, the accuracy of the DNN can continue to be enhanced with further training thereof by adding real data to the training database.

Figure 1:
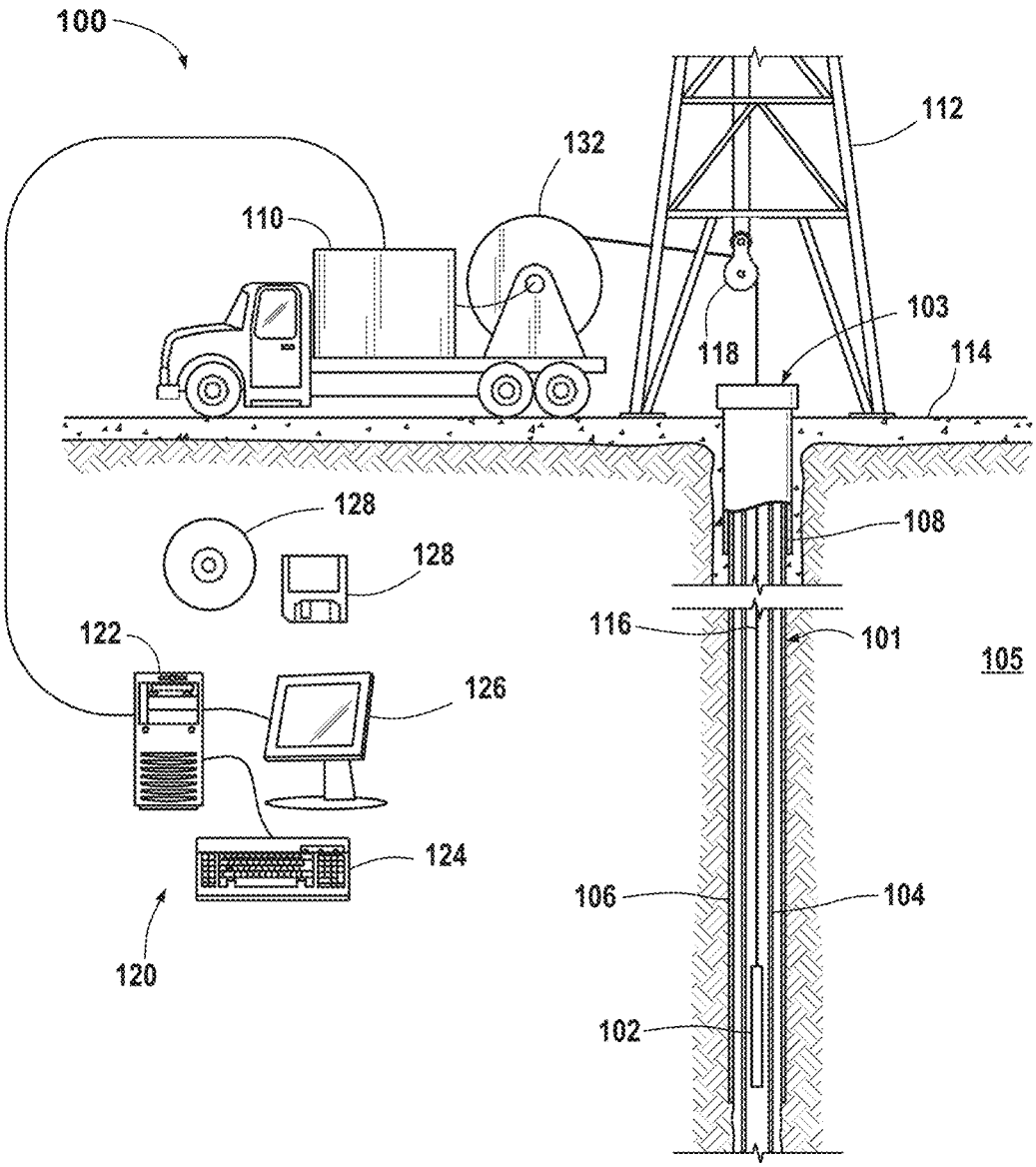
FIG. 1 depicts a schematic diagram of a pipe inspection system, according to one or more embodiments.

FIG. 1 depicts a schematic diagram of a pipe inspection system 100, according to one or more embodiments. In one or more embodiments, the pipe inspection system can be an electromagnetic (EM) well measurements system. However, other well measurements systems or combinations thereof are possible, e.g., nuclear magnetic resonance, acoustic, seismic, pulse neutron, or the like. For example, both acoustic measurements (e.g. for leak detection) and EM measurements can be taken using the pipe inspection system 100. As illustrated, a borehole or wellbore 101 may extend from a wellhead 103 into a subterranean formation 105 from surface 114. Generally, the wellbore 101 may include horizontal, vertical, slanted, curved, and other types of wellbore geometries and orientations. The wellbore 101 may be cased, partially cased, i.e., cased to a certain depth (as shown), or uncased. In one or more embodiments, the wellbore 101 may include one or more metallic tubulars, e.g. pipes, disposed therein. By way of example, the one or more metallic tubulars may be one or more casing, liner, well string, completion string, production tubing, or other elongated steel tubular disposed in the wellbore 101. In one or more embodiments, one or more casing may be disposed in the wellbore 101, e.g. a plurality of casing may be disposed in the wellbore, with at least one casing concentrically disposed in another. As shown, a first casing 106 is concentrically disposed in a second casing 108. The second casing 108 can have a larger diameter than the first casing 106. Though not clearly shown in FIG. 1, the first casing can be radially spaced from the second casing 108 such that an annulus is formed therebetween (see e.g. FIGS. 2-3). Note, although two layers of casing are shown, there can be multiple layers of casing, e.g. 3, 4, 5, 6, or 7 layers of casing. In addition to the casing, in a producing well it is common to have another tubing, e.g. a completion or production string, disposed within the innermost casing. As shown, production tubing 104 is concentrically disposed within the first casing 106. The production tubing 104 can extend into an uncased portion of the wellbore 101.

As illustrated in FIG. 1, the wellbore 101 may extending generally vertically into the subterranean formation 105; however, the wellbore 101 may extend at an angle (although not shown) through the subterranean formation 105, such as horizontal and slanted wellbores. For example, although FIG. 1 illustrates a vertical or low inclination angle well, high inclination angle or horizontal placement of the well and equipment may be possible. It should further be noted that while FIG. 1 generally depicts a land-based operation, the principles described herein are equally applicable to subsea operations that employ floating or sea-based platforms and rigs, without departing from the scope of the disclosure.

The pipe inspection system 100 can include one or more downhole tools disposed on a conveyance 116, which may be lowered into wellbore 101. For example, a downhole tool 102 is disposed on the conveyance 116. As illustrated, the downhole tool 102 is attached to a vehicle 110 via a drum 132. However, in one or more embodiments, it should be noted that the downhole tool 102 may not be attached to the vehicle 110, e.g. being instead attached to a crane or rig. The conveyance 116 and the downhole tool 102 may be supported by a rig 112 at the surface 114.

The downhole tool 102 may be tethered to the vehicle 110 through the conveyance 116. The conveyance 116 may be disposed around one or more sheave wheels 118 to the vehicle 110. The conveyance 116 may include any suitable means for providing mechanical support and movement for the downhole tool 102, including, but not limited to, wireline, slickline, coiled tubing, pipe, drill pipe, downhole tractor, or the like. In some embodiments, conveyance 116 may provide mechanical suspension as well as electrical connectivity for the downhole tool 102. For example, the conveyance 116 may include, in some instances, one or more electrical conductors extending from the vehicle 110 that may be used for communicating power and/or telemetry between the vehicle 110 and the downhole tool 102.

Information from the downhole tool 102 can be gathered and/or processed by information handling system 120. For example, signals recorded by the downhole tool 102 may be stored on memory and then processed by the information handling system 120. The processing may be performed real-time during data acquisition or after recovery of the downhole tool 102. Processing may occur downhole, at the surface, or may occur both downhole and at surface. In some embodiments, signals recorded by the downhole tool 102 may be conducted to the information handling system 120 by way of the conveyance 116. The information handling system 120 may process the signals and the information contained therein may be displayed, and/or visualized, for an operator to observe and stored for future processing and reference. The information handling system 120 may also contain an apparatus for supplying control signals and power to the downhole tool 102.

Systems and methods of the present disclosure may be implemented, at least in part, with the information handling system 120. The information handling system 120 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, the information handling system 120 may be a personal computer, a network storage device, or any other suitable device and may vary in size, shape, performance, functionality, and price. The information handling system 120 may include random access memory (RAM), one or more processing resources such as a central processing unit (CPU) 122 or hardware or software control logic, ROM, and/or other types of nonvolatile memory. Additional components of the information handling system 120 may include one or more disk drives, one or more network ports for communication with external devices as well as an input device 124 (e.g., keyboard, mouse, etc.) and output devices, such as a display 126. The information handling system 120 may also include one or more buses operable to transmit communications between the various hardware components. Although not shown, the information handling system 120 may include one or more network interfaces. For example, the information handling system 120 can communicate via transmissions to and/or from remote devices via the network interface 1005 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.).

Alternatively, systems and methods of the present disclosure may be implemented, at least in part, with non-transitory computer-readable, or machine-readable, media 128. Non-transitory computer-readable media 128 may include any instrumentality or aggregation of instrumentalities that may retain data and/or instructions for a period of time. Non-transitory computer-readable media may include, for example, but not limited to, a system, apparatus, or device, that employs any one of or combination of electronic, magnetic, optical, electromagnetic, infrared, or semiconductor technology to store program code. Non-transitory computer-readable media 128 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other EM and/or optical carriers; and/or any combination of the foregoing. In the context of this document, a computer-readable storage medium may be any tangible medium that can contain or store a program for use by or in connection with an instruction execution system, apparatus, or device. For example, the computer-readable storage medium can comprise program code executable by a processor to cause the processor to perform one or more steps. The computer-readable storage medium can further comprise program code executable by the process to cause or initiate the one or more downhole tools to perform a function, e.g., transmitting a signal, receiving a signal, and/or taking one or more measurements.

The computer-readable media 128 may be a machine-readable signal medium or a machine-readable storage medium. A computer-readable storage medium is not a machine-readable signal medium. A machine-readable signal medium may include a propagated data signal with machine-readable program code embodied therein, for example, in baseband or as part of a carrier wave. Such a propagated signal may take any of a variety of forms, including, but not limited to, electro-magnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on computer-readable media 128 may be transmitted using any appropriate medium, including but not limited to wireless, wireline, optical fiber cable, radio frequency (RF), etc., or any suitable combination of the foregoing. Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and procedural programming languages, such as the "C" programming language or similar programming languages. The program code may execute entirely on a stand-alone machine, may execute in a distributed manner across multiple machines, and may execute on one machine while providing results and or accepting input on another machine. The program code/instructions may also be stored in a machine-readable medium that can direct a machine to function in a particular manner, such that the instructions stored in the computer-readable storage medium produce an article of manufacture including instructions which implement the function/act specified in the flowchart and/or block diagram block or blocks.

Figure 2:
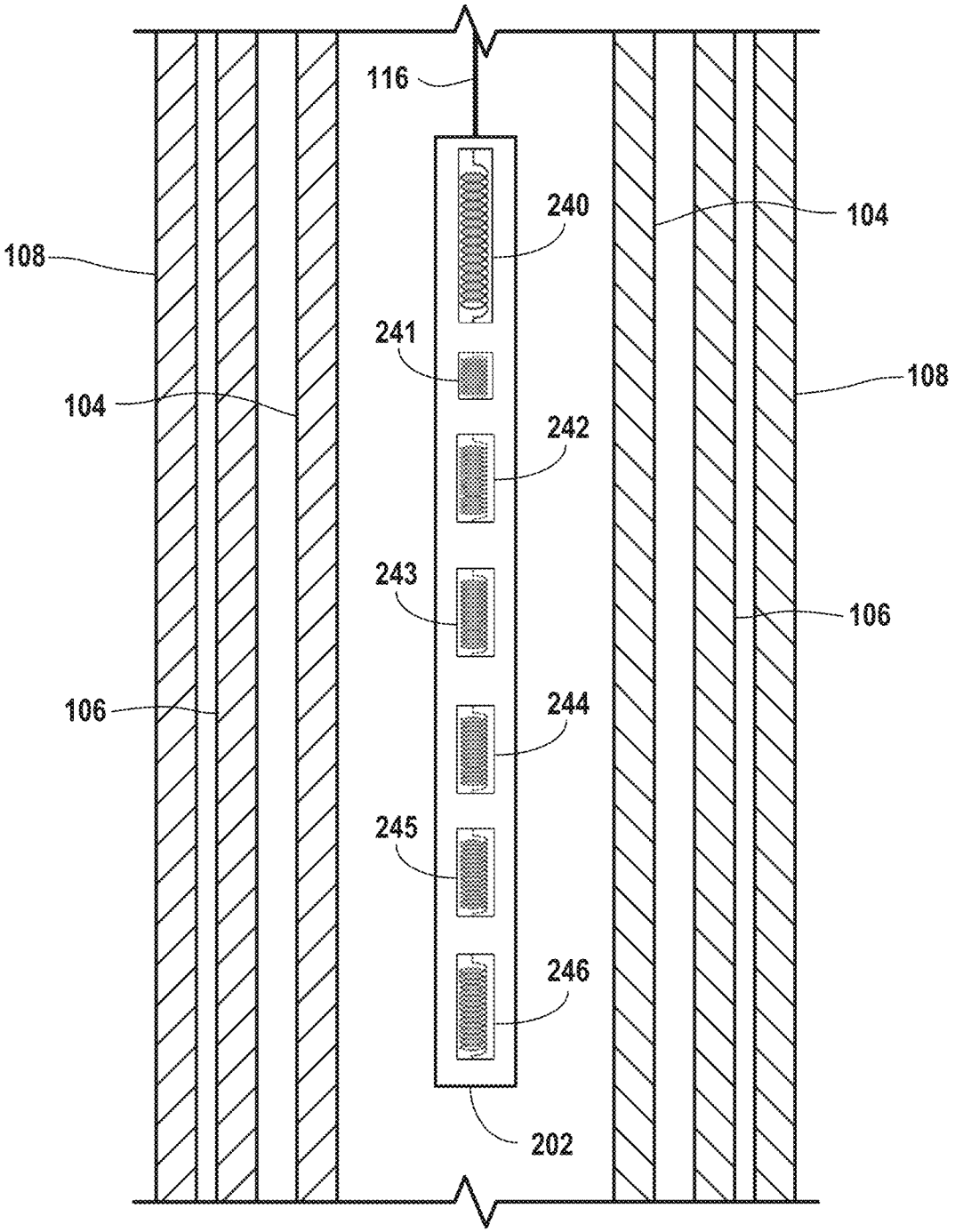
FIG. 2 depicts a cross-sectional view of a frequency-domain tool used for pipe inspection, according to one or more embodiments.
Figure 3:
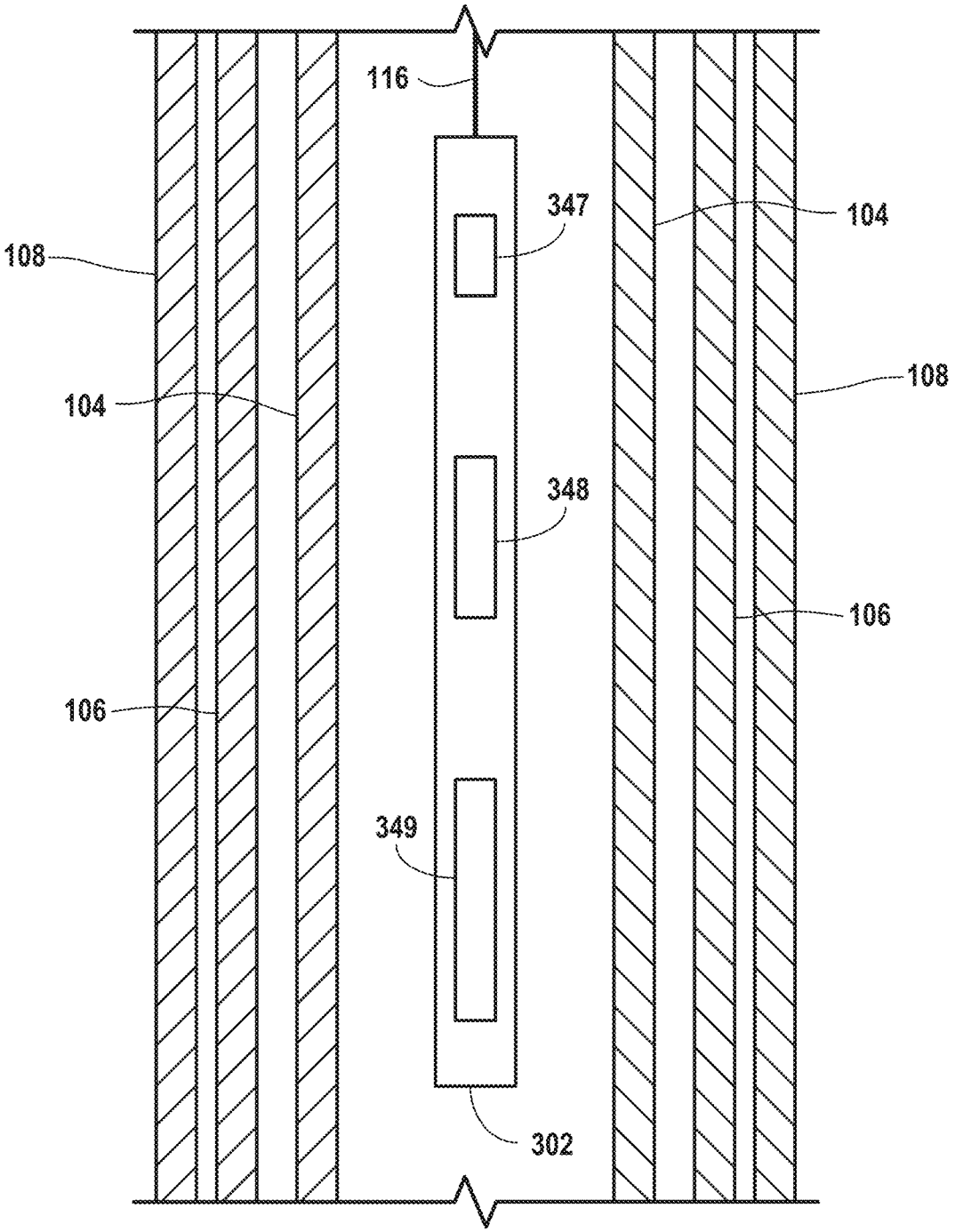
FIG. 3 depicts a cross-sectional view of a time-domain tool used for pipe inspection, according to one or more embodiments.
Figure 4:
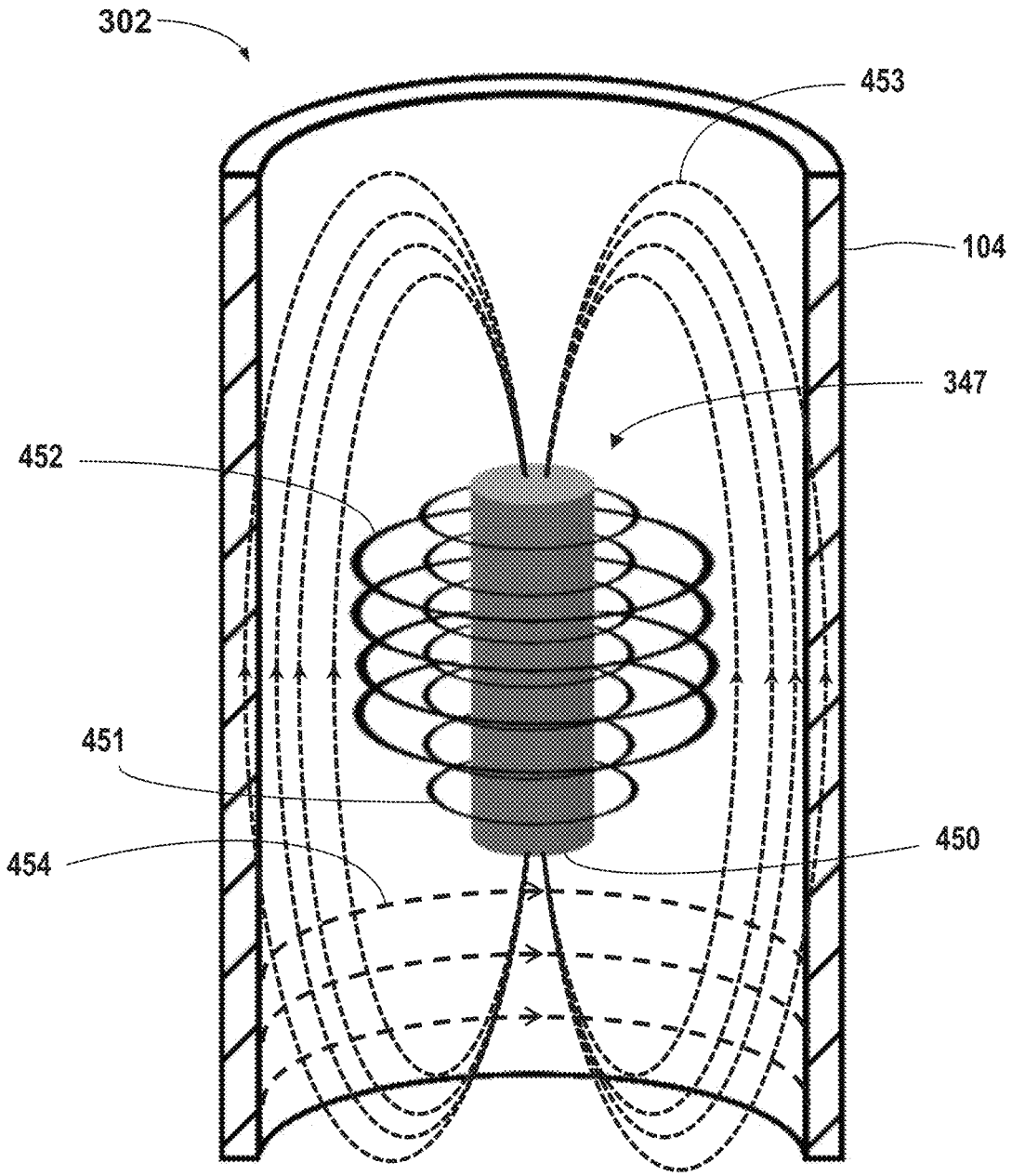
FIG. 4 depicts a partial cross-sectional view of a transceiver of the time-domain tool, according to one or more embodiments.

Turning now to FIGS. 2-4, as one kind of electromagnetic (EM) technique for performing pipe inspection, the eddy current (EC) effect of an EM wave can be applied to develop a tool to characterize the tubulars (e.g. production tubing 104, first casing 106, and second casing 108) around the wellbore 101. The EC techniques can be divided into two categories—frequency-domain EC techniques and time-domain EC techniques.

FIG. 2 depicts a cross-sectional view of a frequency-domain tool 202 used for pipe inspection, according to one or more embodiments. The frequency-domain tool 202 is shown suspended from the conveyance 116 and disposed within multiple nested tubulars (depicted as three layers of tubulars, i.e. production tubing 104, first casing 106, and second casing 108). Although three layers of tubulars, i.e. three layers of nested pipe, are shown, the frequency-domain tool 202 could be deployed in a greater number of tubulars, as mentioned above.

The frequency-domain tool 202 can have one or more transmitters and one or more receivers. In one or more embodiments, the frequency-domain tool 202 has a transmitter 240 and a plurality of receivers spaced apart from each other (six receivers are shown: a first receiver 241, a second receiver 242, a third receiver 243, a fourth receiver 244, a fifth receiver 245, and a sixth receiver 246). In one or more embodiments, each of one or more transmitters and receivers is a coil. The coils can be wrapped around a core. The coils can be axially aligned with the tool 202 or can be tilted coils. The coils can be tri-axial, multiaxial, and/or multi-directional. The one or more transmitter and receivers can be of different sizes and/or of different relative strengths.

In frequency-domain EC techniques, a transmitter coil of the one or more transmitters is fed by a continuous sinusoidal signal, producing primary electromagnetic (EM) fields that illuminate the tubulars. The primary fields produce (or induce) eddy currents in the tubulars. These eddy currents, in turn, produce secondary EM fields that are sensed or measured along with primary fields in the receiver coils of the receivers that are placed at a distance from the one or more transmitters. Characterization of the tubulars is performed by measuring and processing these fields. Measurements by the receivers in frequency-domain tool 202 are performed at different transmitted frequencies, e.g. ranging from 0.1 Hz to 1000 Hz. In one or more embodiments, higher frequencies (e.g. between 0.1 Hz to about 20 HZ) may be used for the inner or innermost tubulars, and lower frequencies (e.g. between 10 Hz and 1000 Hz) may be used for the outermost tubulars. (Note, lower and higher ranges may be varied depending on the tool design and the anticipated tubular spacing.)

In one or more embodiments, the transmitter 240 transmits primary EM fields at one or more frequencies, and at least one receiver of the receivers 241-246 measures at least one of a real-part, imaginary-part, an absolute, or a phase of secondary EM fields, wherein the secondary EM fields are produced from eddy currents induced in the one or more tubulars, by the primary EM fields.

In one or more embodiments, the measurements by the one or more receivers at each depth is recorded in a log, such as a variable density log (VDL) and then processed to form a response image. Each receiver and frequency form a "channel" in the image, such that the image represents multiple channels. The response image is a reflection of how much each channel changes, e.g. how the channel's response varies from a nominal or expected value, when it encounters a feature, i.e. an anomaly or defect in at least one of the tubulars, at a particular depth. The change in the channel can be representative of tubular integrity properties the multiple tubulars. A tubular integrity property can include cross-sectional thickness, a magnetic permeability, an electrical conductivity, or a combination thereof.

FIG. 3 depicts a cross-sectional view of a time-domain tool 302 used for pipe inspection, according to one or more embodiments. Like the frequency-domain tool 202, the time-domain tool 302 is shown suspended from the conveyance 116 and disposed within multiple nested tubulars (depicted as three layers of tubulars, i.e. production tubing 104, first casing 106, and second casing 108). The time-domain tool 302 can have one or more transmitters and one or more receivers. receivers and transmitters of the time-domain tool 302 are co-located. In one or more embodiments, the For example, the time-domain tool 302 can have one or more transmitter-receiver pairs, i.e. transceivers, spaced along the axial direction of the tool body of time-domain tool 302 (three transceivers, first transceiver 347, second transceiver 348, and third transceiver 349, are shown). In one or more embodiments, the transmitter(s) and receivers of the time-domain tool 302 are not co-located, with the receiver(s) spaced apart from the transmitter(s).

In time-domain EC techniques (also referred to as pulsed EC), the transmitter of each transmitter-receiver pair sends out transient fields, which can produce eddy currents in the tubular(s). The eddy currents then produce secondary magnetic fields that are measured by either a separate receiver coil placed further away from the transmitter or a separate coil co-located with the transmitter.

FIG. 4 depicts a partial cross-sectional view of a transceiver (the first transceiver 347 is shown) of the time-domain tool 302, according to one or more embodiments. As shown, the first transceiver 347 is disposed in the production tubing 104. The first transceiver 347 has a transmitter coil 451 and receiver coil 452 both wrapped around a magnetic core 450. The receiver coil 452 is co-located with the transmitter coil 451. The transmitter coil 451 emanates a transient magnetic field 453. The transient magnetic field 453 produces eddy currents 454 in the production tubing 104. The eddy current 454 produce secondary magnetic field (not shown, but parallel with the transient magnetic field) that is measured by the receiver coil 452. The strength of the secondary magnetic field decays versus time, and a decay response is measured by the receiver coil 452 after the transmitter coil 451 is turned off. The strength of the response at different times, i.e. time bins, is sensitive to parameters of the different nested tubulars. For example, early times are more sensitive to the innermost tubular, e.g. the production tubing 104, whereas later times are sensitive to both the inner and outer tubulars, e.g. production tubing 104, the first casing 106, and the second casing 108. The decay response, i.e. samples with different time delay, is thus indicative of the tubular integrity property of the tubulars.

The eddy current 454 measured by the receiver coil 452, i.e., a received signal, is proportional to the amount of metal that is around transmitter coil 451 and the receiver coil 452. For example, less signal magnitude is typically an indication of more metal, and more signal magnitude is an indication of less metal. This relationship may be utilized to determine metal loss, which may be due to an abnormality or defect related to the tubular, e.g. due to corrosion or buckling. The received signal, i.e. the measured eddy current, can be processed to produce a response image representing the magnitude of the response compared with a nominal or expected value for each transmitter-receiver pair (which, like the frequency-domain, can be treated as "channels"). As such, like the frequency-domain tool, the response image from the time-domain tool 302 can be a reflection of how each channel changes, e.g. how the channel's response varies from a nominal or expected value, when the channel encounters a feature at a particular depth.

Figure 5:
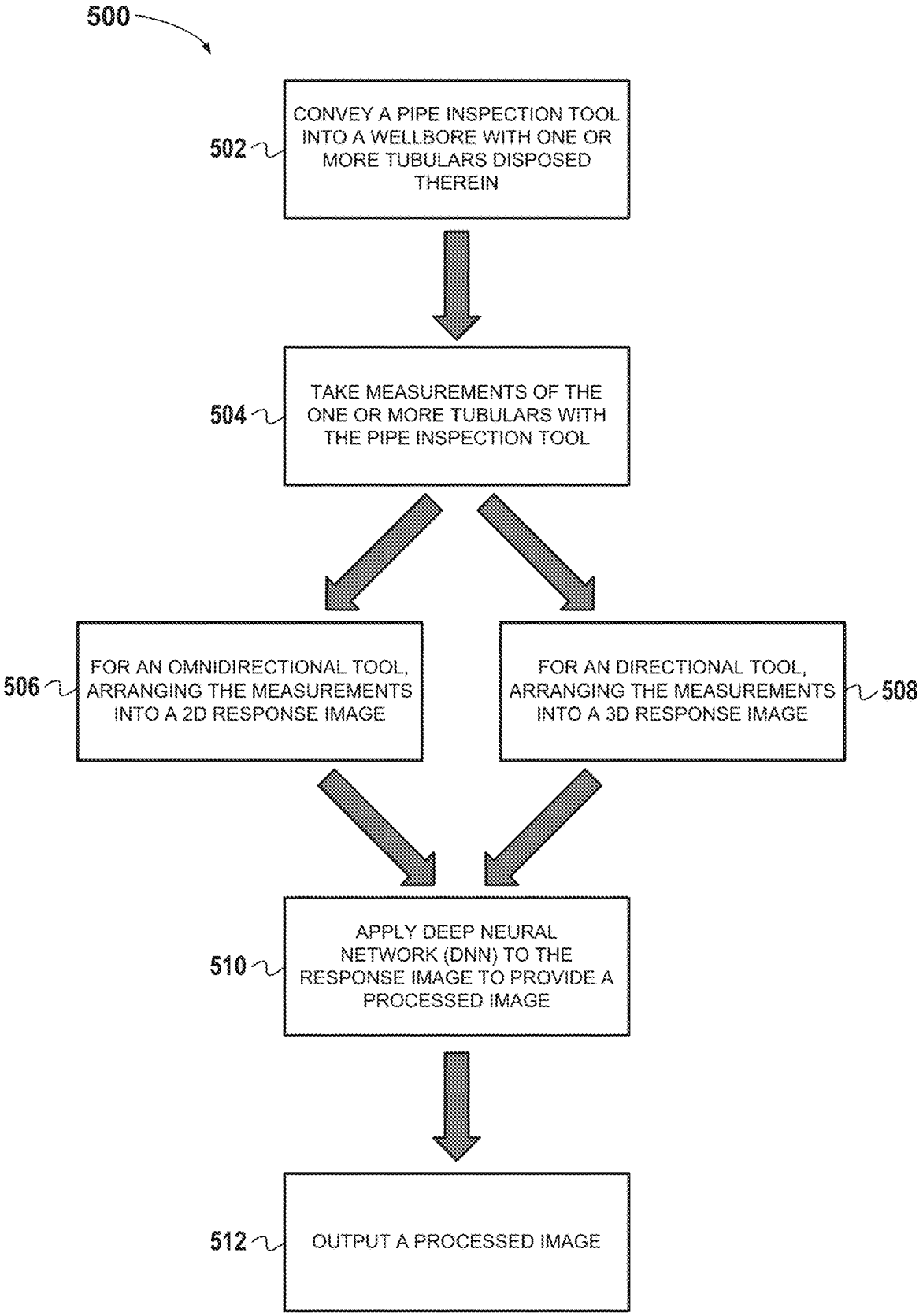
FIG. 5 depicts a flowchart of a machine learning based method for pipe inspection, according to one or more embodiments.

FIG. 5 depicts a flowchart of a machine learning based method 500 for pipe inspection, according to one or more embodiments. At 502, an electromagnetic pipe inspection tool (e.g. the downhole tool 102, the frequency-domain tool 202, or the time-domain tool 302) is disposed into a wellbore (e.g. wellbore 101) having one or more tubulars disposed therein (e.g. production tubing 104, first casing 106, and second casing 108, or more tubulars). In one or more embodiments, the one or more tubulars are multiple nested tubulars, and the pipe inspection tool is disposed, e.g. conveyed via a conveyance, inside an inner most tubular of the multiple nested tubulars.

At 504, measurements of the one or more tubulars are taken with the pipe inspection tool, e.g. via one or more receivers. For example, a transmitter (e.g. the transmitter 240 or a transmitter in one of the transceivers 347-349) can produce a current (as described above with the two different types of tools) that is measured by one or more receivers (e.g. the receivers 241-246 or the receivers of the transceivers 347-349). These measurements taken over depth are the response, i.e. raw measurements over depth. The initial measured response can be output as a log of raw measurements for each receiver. In one or more embodiments, the measurements taken are initiated by one or more non-transitory machine-readable media comprising program code for inspecting the integrity of multiple nested tubulars.

In a frequency-domain tool, one or more transmitters transmit EM fields at multiple frequencies. The frequency-domain tool measures, at each receiver, at least one of the real-part, imaginary part, the absolute (i.e. the magnitude), the amplitude, or the phase of the current produced by the one or more transmitters at each of the multiple frequencies. In a time-domain tool, one or more transmitters excite the one or more tubulars with a pulsed EM field. The time-domain tool measures, at each receiver, the decay response of the pulses in the time-domain. The decay response measured by the one or more receivers, e.g. multiple receivers, includes multiple time delays.

In addition to operating in either the frequency-domain or the time-domain, the pipe inspection tool can be configured to operate in at least two different ways: as an omnidirectional tool or as a directional (e.g. azimuthal) tool. In an omnidirectional tool, the raw signal received represents the total signal at depth, i.e. not a signal that is azimuthally sensitive. In a directional tool, the signal received only represents a single direction, e.g. an azimuthal bin. Azimuthal measurements can be taken through a variety of different ways at depth. For example, the transmitter and/or the receiver can be titled antennas. In another example, the transmitter(s) and or receivers can be tri-axial, multi-directional, and/or multi-axial coils. In yet another example, one or more shields, e.g. one that blocks or limits transmission of EM waves, can rotate only allow transmission or receipt of a signal in a particular azimuthal angle. In the directional tool, azimuthal measurements of the nested tubulars are taken with the pipe inspection tool.

At 506, for an omnidirectional tool, the measurements are arranged into, e.g. accumulated to form, a two-dimensional (2D) response image, i.e. a 2D representation of the tool response. For a frequency-domain tool, measurements over depth for each receiver at each frequency make up a log for each receiver, e.g. with depth on the Y axis, frequency bands on the X axis, and color/greyscale/brightness gradient representing the difference from a nominal value (the nominal value determined via calibration). Each measurement at each depth and frequency is mapped to a log data point on the log to form the log for each receiver. The log data point can also be a line perpendicular to the Y-axis, i.e. instead of a single point. Each log of each receiver forms a channel in the 2D response image, such that the 2D response image represents multiple channels. For example, the logs from multiple receivers and multiple frequencies can be juxtaposed to form the 2D response image. The 2D response image is a reflection of how much each channel changes, e.g. how the channel's response varies from a nominal or expected value, when it encounters a feature, i.e. an anomaly or defect in at least one of the tubulars, at a particular depth. (Depth here refers to an axial measurement of depth along the axis of the tubular(s), sometimes referred to as "measured depth" or "logging depth".)

For the frequency-domain response image, a first dimension of the 2D response image is the depth and a second dimension is the channels of different receivers. In one or more embodiments, each log data point is represented by a pixel in the 2D image, and a value assigned to each pixel in the 2D response image is proportional to a percentage change of each log data point from a nominal value of that log data point. For example, in the 2D response image the pixel value can be displayed as a color, gray scale, or brightness (e.g. based on a numeric scale) and can represent a difference (e.g. a percentage difference) of the frequency, e.g. the frequency magnitude, from the nominal value of that pixel.

In a time-domain tool, measurements can be processed to produce a response image representing the magnitude of the response compared with a nominal or expected value for each transmitter-receiver pair, e.g. based on a decay response with respect to a nominal value at different time delays, i.e. "time bins". The decay response measured by the multiple receivers comprises multiple samples with different time delays. Measurements over depth for each receiver of the multiple receivers, e.g. the measurements of a secondary magnetic field at each depth and at each time sample of the multiple time samples, form a log for each receiver. In at least one example, the log has depth on the Y axis, time increments on the X axis, and color/greyscale/brightness gradient representing the difference in the decay response from a nominal value (the nominal value determined via calibration) at the particular time increment. Each measurement at each depth and time is mapped to a log data point on the log to form the log for each receiver. The log data point can also be a line perpendicular to the Y-axis, i.e. instead of a single point. Each log of each receiver forms a channel in the 2D response image, such that the 2D response image represents multiple channels. For example, the logs from multiple receivers and multiple time bins sampling the decay response can be juxtaposed to form the 2D response image. The 2D response image is a reflection of how much each channel changes, e.g. how the channel's response varies from a nominal or expected value, when it encounters a feature, i.e. an anomaly or defect in at least one of the tubulars, at a particular depth.

For the time-domain response image, a first dimension of the 2D response image is the depth and a second dimension of the 2D response image is time bins sampling the decay response returned by the tubulars. In one or more embodiments, each log data point is represented by a pixel in the 2D image, and a value assigned to each pixel in the 2D response image is proportional to a percentage change of each log data point from a nominal value of that log data point. For example, in the 2D response image for the time domain tool the pixel value can be displayed as a color, gray scale, or brightness (e.g. based on a numeric scale) and can represent a difference (e.g. a percentage difference) of the decay response with respect to the nominal value of that pixel.

At 508, for a directional tool, the measurements taken in each direction, e.g. each azimuthal bin or each azimuthally placed receiver, are arranged into, i.e. accumulated to form, a three-dimensional (3D) response image, i.e. a 3D representation of the tool response. The directional tool can operate in the frequency domain or in the time domain. The 3D response image is a 3D representation of the tool response wherein a first dimension is depth, i.e. measured depth, a second dimension is azimuth, and a third dimension is a juxtaposition of measurements from multiple receivers and either multiple frequencies, for a frequency-domain tool, or time delay, for a time-domain tool, at a given depth point and angular direction.

At 510, a deep neural network (DNN) is applied to the response image, e.g. the 2D response image from an omnidirectional tool or the 3D response image from the directional tool, to provide a processed image. In one or more embodiments, the response image is fed to a pre-trained DNN to produce one or more processed images representative of a tubular integrity property of each individual tubular of the multiple nested tubulars. In one or more embodiments, the response image is split into sections based on depth, and each section is separately and/or sequentially fed to the DNN. Herein, a neural network is considered "deep" when a network has a plurality of layers, i.e. more than three layers. For example, a DNN has at least in input layer, an output layer, and one or more hidden layers, e.g. multiple hidden layers. In one or more embodiments, the DNN has at least one convolutional layer. A DNN with at least one convolutional layer is hereafter referred to as a convolutional neural network (CNN). A convolutional layer is defined as a layer in a neural network that implements a convolution. A convolution can include a cross-correlation. In one or more embodiments, the DNN is not a conventional DNN. The CNN can include one or more convolutional layers plus one or more fully connected layers, one or more pooling layers (e.g. local, global, max, or average pooling), one or more up-sampling layers, one or more dense layers, one or more concatenation layers, one or more summation layers, and/or other available layers used in CNNs. The learning in the CNN can be done at multiple levels, e.g. using microscope to capture fine details and telescope to see a bigger picture, to find both small and big errors.

Figure 6:
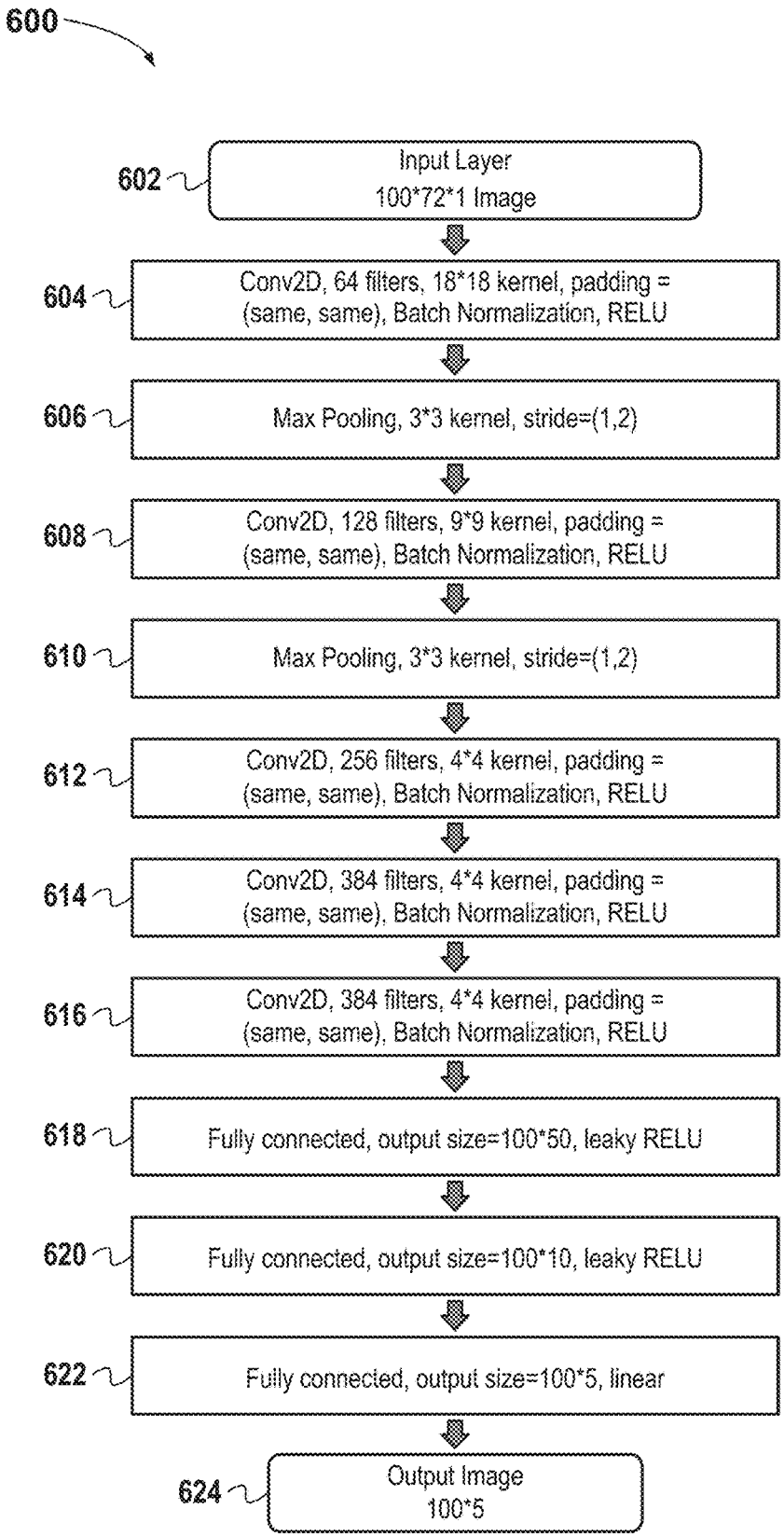
FIG. 6 depicts an example of an example architecture of a deep neural network (DNN) having at least one convolutional layer, according to one or more embodiments.

FIG. 6 depicts an example architecture 600 of a DNN having at least one convolutional layer, according to one or more embodiments. In the architecture 600, the size of the input image, e.g. the 2D response image or the 3D response image, is M*N*P, where M is the number depth points (points over depth where measurements are taken), Nis the number of measured signals at a single depth point, and P is the number of channels for each signal. In the example shown by the architecture 600, an input layer 602 takes a response image where M=100, N=72, P=1. The size of output image, e.g. the processed image, is M*K, where K is the number of individual tubulars, i.e. the number of pipes. The individual tubular integrity property can be also referred to as the tubular integrity property parameters. In the example shown by the architecture 600, at an output layer 624, a processed image is output where M=100 and K=5, i.e. the output image has 100 depth points and 5 individual tubular integrity property for 5 tubulars.

Between the input layer 602 and the output layer 624 are 10 layers, i.e. 10 hidden layers 604-622. Although 10 layers are shown in this example architecture 600, there could be only 1 hidden layer, between 2 and 9 hidden layers, or more than 10 hidden layers. A first hidden layer 604 is a first convolutional layer, e.g. a 2D convolutional layer ("Conv2D") with one or more 2D filters (i.e. one or more convolutional filters), with padding and batch output applied and having a RELU activation function. The first convolutional layer has 64 filters with an 18*18 kernel. A second hidden layer 606 is a first max pooling layer with a 3 by 1 window size in the windows first and second dimension, respectively, and a stride of 2 and 1 in the first and second dimension, respectively. A third hidden layer 608 is a second convolutional layer with padding and batch output applied and having a RELU activation function. The second convolutional layer has 128 filters with a 9*9 kernel.

A fourth hidden layer 610 is a second max pooling layer with a 3 by 1 window size in the windows first and second dimension, respectively, and a stride of 2 and 1 in the first and second dimension, respectively. A fifth hidden layer 612 is a third convolutional layer with padding and batch output applied and having a RELU activation function. The third convolutional layer has 256 filters with a 4*4 kernel. A sixth hidden layer 614 is a fourth convolutional layer with padding and batch output applied and having a RELU activation function. The fourth convolutional layer has 384 filters with a 4*4 kernel. A seventh hidden layer 616 is a fifth convolutional layer with padding and batch output applied and having a RELU activation function. The fifth convolutional layer has 384 filters with a 4*4 kernel.

An eighth hidden layer 618 is a first fully connected layer having an output size of 100*50 and using a leaky RELU activation function. A ninth hidden layer 620 is a second fully connected layer having an output size of 100*10 and using a leaky RELU activation function. A tenth hidden layer 622 is a third fully connected layer having an output size of 100*5 and using a leaky RELU activation function.

The tenth hidden layer 622 feeds into the output layer 624 described above to provide the processed image.

The example architecture 600 is just one way of constructing a DNN with one convolutional layer, i.e. constructing a CNN. Other configurations can be used for different input sizes or different processing. For example, although not shown in FIG. 6, the convolutional filters in one or more of the convolutional layers can be a 3D filter instead of a 2D filter. The 3D filter can be used, for example, when the DNN is fed a 3D response image from a directional tool. In another example, one or more concatenation layers, e.g. to concatenate two images is a third dimension, or one or more summation layers, e.g. to sum two images is a third dimension, and one or more up-sampling layers can be used. Further, different numbers of convolutional, pooling, and fully connected layers can be used, as well as different parameter settings for each layer shown and any different layers added.

Referring again to FIG. 5, at 512, the method 500 can output the processed image. For example, the processed image can be displayed, recorded, printed, or fed to another method. The processed image includes a representation of a tubular integrity property of each individual tubular of the multiple nested tubulars. For example, the processed image can include a representation of at least one of the cross-sectional thickness, magnetic permeability, and electrical conductivity of each individual tubular of the multiple nested tubulars. Other parameters of the tubulars can also be included in the processed image, such as eccentricity, ovality, or the like. The processed image is made up of pixels. In one or more embodiments, a value is assigned to each pixel of the processed image is proportional to a percentage change of the tubular integrity property of each of the individual tubulars of the multiple nested tubulars from a nominal tubular integrity property of each of the individual tubulars of the multiple nested tubulars.

The processed image can include the location of the defects in the multiple nested tubulars and noted variance of the tubular integrity property of the individual tubulars, and thereby can provide a report of the integrity of the multiple nested tubulars. For example, when the tubular integrity property is cross-sectional thickness, the processed image can highlight where the cross-sectional thickness is below a nominal value, including how severely below the nominal value. As such, the whole method is considered an inspection of the integrity of the multiple nested tubulars.

FIG. 5 is annotated with a series of numbered blocks 502-512. These numbered blocks represent stages of operations. Although these stages are ordered for this example, the stages illustrate one example to aid in understanding this disclosure and should not be used to limit the claims. Subject matter falling within the scope of the claims can vary with respect to the order and some of the operations.

Figure 7:
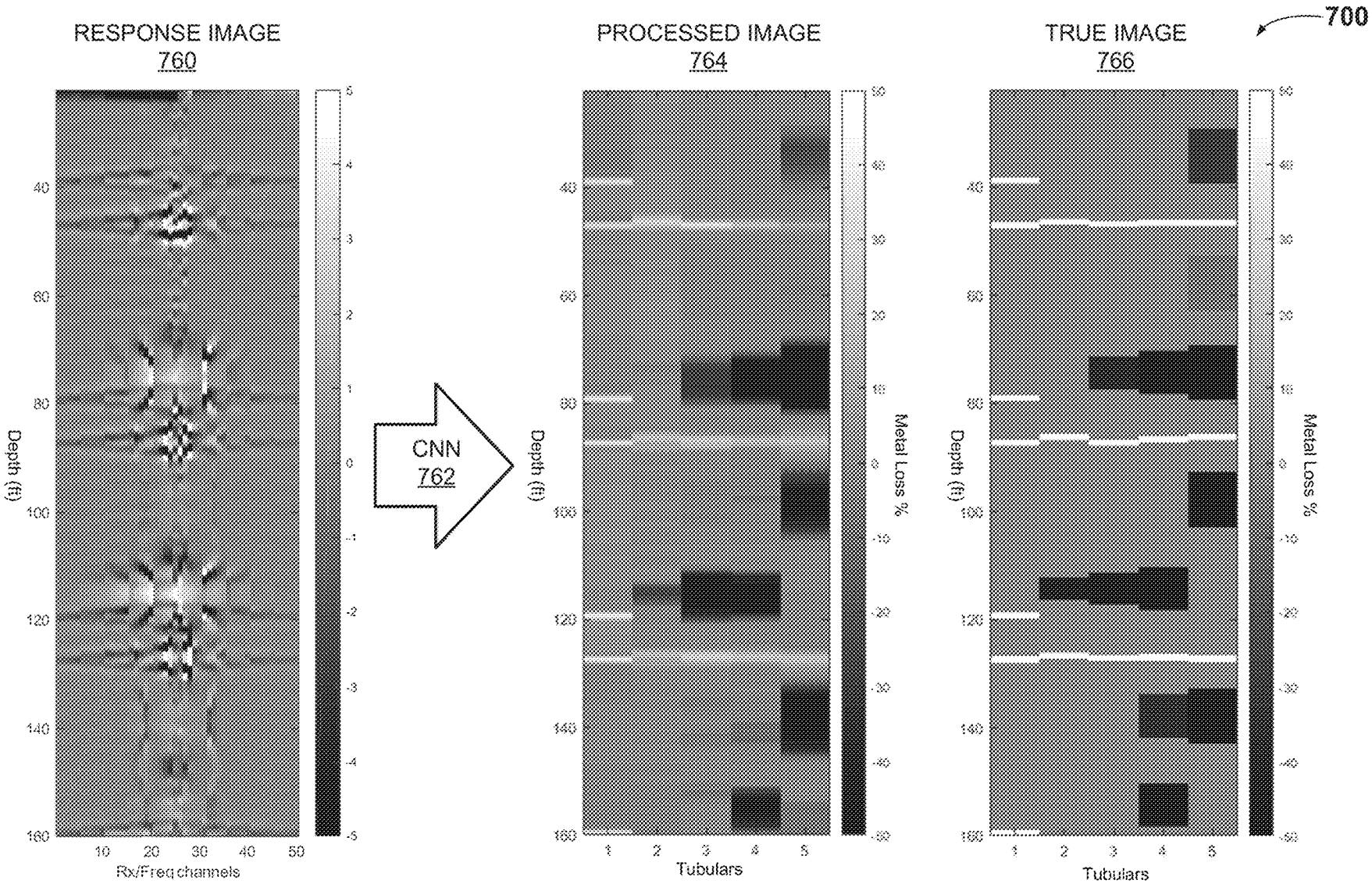
FIG. 7 illustrates an example of tubular thickness estimation using a convolutional neural network (CNN), according to one or more embodiments.

FIG. 7 illustrates an example of tubular thickness estimation 700 using a pre-trained CNN 762, according to one or more embodiments. Although the estimation 700 focuses on thickness, the same technique could be applied for any tubular integrity property. For this example, a controlled test, e.g. a yard test, was performed using a set of five nested tubulars, i.e. concentric pipes. The five nested tubulars had outer diameters (OD) of 18⅝ inches ("), 13⅜", 9⅝", 7", and 2⅞", respectively, with the 2⅞" OD tubing being the innermost tubular and the 18⅝" OD tubing being the outermost tubular. Several defects were machined on each one of the five nested tubulars. Some of the defects were overlapping and others were not. In addition, the defects had different axial lengths ranging from 2 feet (ft) to 10 ft, and the defects had different metal loss ranging from 7.6% to 65%, with respect to nominal thickness. The details of the five nested tubulars is shown in the true image 766 having depth shown on the Y axis and the number of tubulars shown in the X axis. The metal loss percentage for each tubular at each depth point is shown as a greyscale gradient spanning from 50 to negative 50, with 0 representing nominal tubular thickness. The positive pixel values in the true image, shown as the lightest color or shade, show the location of pipe collars on each tubular, as the collars have a tubular thickness greater than the nominal tubular thickness. As shown, the 2⅞" OD tubing (the first or innermost tubular) has seven pipe collars (represented by the seven horizontal light lines) but no defects. The rest of the tubulars each have three collars and varying defects (represented by the darker colored pixel values, with the darkest color representing the highest metal loss percentage). For example, 18⅝" OD tubing (the fifth and outermost tubular) has three collars and five defects of varying metal loss percentage.

The raw measurements of the five nested pipes with an omnidirectional tool are shown in a response image 760, i.e. a 2D response image, having depth on the Y axis, frequency channels on the X axis, and a greyscale gradient representing the difference in the frequency from a nominal value. As depicted, the nominal value of the gradient is 0, the high frequency value is 5, and the low frequency value is −5. The difference in frequency can be scaled to match the gradient. As shown, some points are above the nominal value, represented by a lighter shade, and some points are below the nominal value, represented by a darker shade.

The tubular thickness estimation 700 in the example then applied the method 500 for an omnidirectional tool. The response image 760 was fed to the pre-trained CNN 762 (a pre-trained DNN having at least one convolutional layer) to produce a processed image 764 representative of a cross-sectional thickness of each individual tubular of the multiple nested tubulars. The processed image 764 is juxtaposed in FIG. 7 next to the true image 766, having the same axes and greyscale gradient. Note, while the greyscale gradient for any of the images could also be a color scale or the like. As depicted, a value is assigned to each pixel of the processed image is proportional to a percentage change of each of the cross-sectional thicknesses of each of the individual tubulars of the five nested tubulars from a nominal cross-sectional thickness of each of the individual tubulars of the five nested tubulars. The example demonstrated that the processed image 764 accurately depicted both the collars and the defects present in the true image 766.

Figure 8:
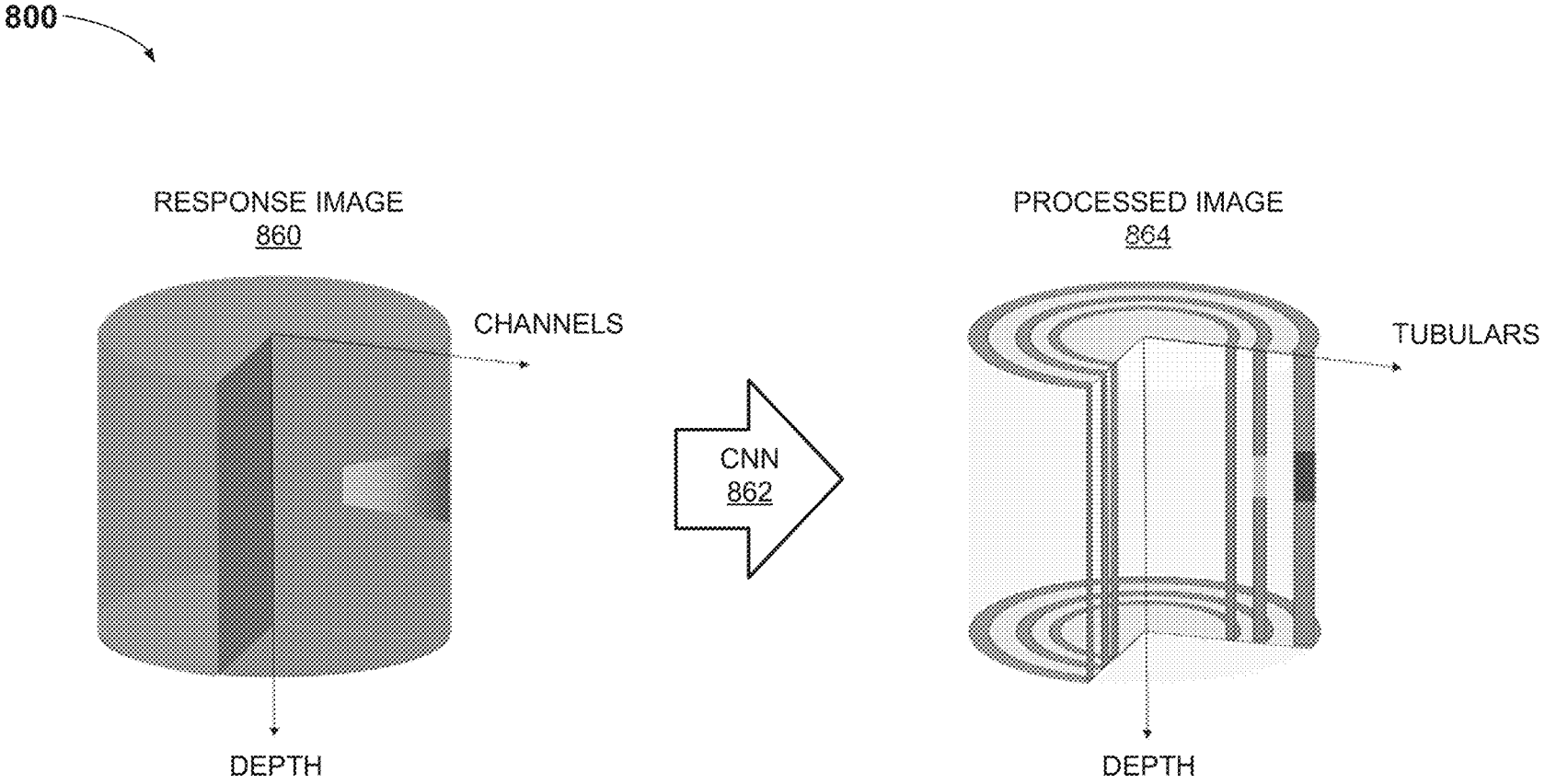
FIG. 8 illustrates an example of 3D tubular integrity property estimation using a CNN, according to one or more embodiments.

FIG. 8 illustrates an example of 3D tubular integrity property estimation 800 using a CNN 862, according to one or more embodiments. In this example, a 3D response image 860 is obtained from a directional tool, e.g. azimuthal tool, or simulated to be obtained therefrom conveyed inside the innermost tubular of a set of multiple nested tubulars. The vertical axis of the 3D response image 860 is depth and radial axis for each azimuth are channels (either frequency or time delay, depending on the tool type). The channels span outward with increasing depth of investigation (DOI) and are a juxtaposition of measurements from multiple receivers and multiple frequencies/time delays (depending on the tool type) at a given depth point and angular direction.

The 3D response image 860 is fed to the CNN 862 (a pre-trained DNN having at least one convolutional layer) to produce a 3D processed image 864 representative of a tubular integrity property of each individual tubular of the multiple nested tubulars. The 3D processed image 864 is able to display the defect in each tubular of the set of multiple tubulars and the azimuthal, i.e. angular, position of the defects. Although not depicted explicitly, the percentage of metal loss, i.e. the defects, can be represented with a gradient as done in FIG. 7 for the 2D images. For example, the defects are represented in the 3D processed image 864 a light and dark colorations which can indicate metal loss (or metal gain) at the particular depth and azimuthal location.

Figure 9:
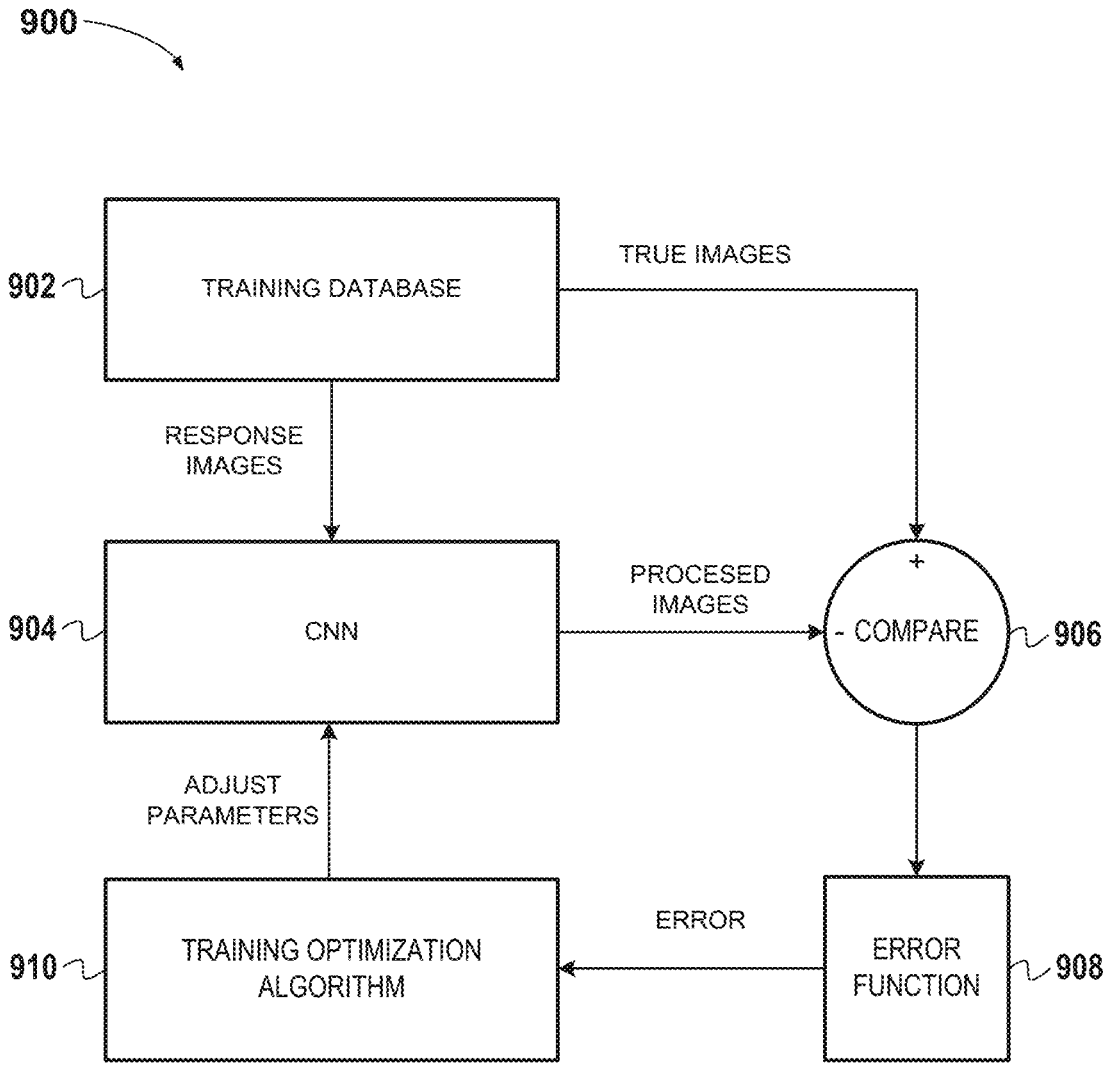
FIG. 9 depicts a flowchart of a method for training a DNN having at least one convolutional layer, according to one or more embodiments.

FIG. 9 depicts a flowchart of a method 900 for training a DNN having at least one convolutional layer, according to one or more embodiments. In one or more embodiments, the DNN with at least one convolutional layer, e.g. CNN 904, is be pre-trained. Training the DNN begins with building a training database 902 using at least one of simulation or measurements of known cases. The training database 902 is built with a plurality of samples. Each sample of the plurality of samples includes a true image of tubular integrity property of one or more nested tubulars and a corresponding response image. Both the true image and the response image used for the sample are for a corresponding number of depth points. For example, a sample can be obtained using simulations, e.g. simulated raw response images for a simulated true image of a simulated set of one or more tubulars. A sample can also be obtained by raw measurements of known case, i.e. by recording raw response images based on real measurements for multiple nested tubulars, where the multiple nested tubulars have known defects which are captured as the true image for purposes of training the DNN.

The more samples in the training database 902 and the more diverse the samples, the better the performance of the DNN. The training database 902 can comprise at least 10,000 samples. The samples can have different number of tubulars, different positions of the tubulars, different thicknesses, different physical properties (e.g., resistivity, permittivity, conductivity, permeability, etc.) of material near the tubulars, different parameters of eccentricity of the tubulars, different ovality, different bending, etc., and combinations thereof.

To begin training, the sample response images from the training database 902 are fed to the CNN 904 (i.e. a DNN having one or more convolutional layer) to produce output images, i.e. processed images. The process of training finds optimum network parameters to minimize misfit between processed images produced by the CNN 904 and corresponding true images in the training database 902 according to an error metric. The CNN 904 outputs a processed image, and the corresponding true image from the training database 902 is compared at 906 with the processed image. The comparison 906 is evaluated via an error function 908. The error function 908 is defined as the sum of square errors of the logarithm of resistivity for each pixel, represented by the following equation:

$$E_n=\Sigma_{i=1}^{M}(p_i-q_i)^2 \quad (1)$$

where $E_n$ is the error between the true image and the processed image produced by the CNN 904 for the $n^{th}$ training example, n is the index of training examples, i is the index of pixels, Mis the number of pixels in an image, p is the true image (i.e. with true tubular integrity property values of the tubular(s)), and q is the processed image (i.e. with the processed tubular integrity property values of the tubular(s)).

The calculated error is fed to a training optimization algorithm 910 which can include a loss function defined as the mean square error for a whole training batch defined, represented as follows:

$$L=\Sigma_{n\in batch}E_n \quad (2)$$

where L is the loss function, and batch represents the whole training batch. The loss can also be calculated using mini-batches, e.g. using mini-batch gradient descent, where the minibatches are a subset of the total dataset. The size of the minibatch is a hyperparameter that can be adjusted during training to optimize results. Other network parameters, e.g. hyperparameters, weight parameters, of the CNN can be adjusted based on the training optimization algorithm 910. In one or more embodiments, the training optimization algorithm can use gradient descent.

In one or more embodiments, cross-validation, e.g. exhaustive or non-exhaustive, is used to evaluate the accuracy of the CNN 904. For example, K-fold cross-validation can be used to evaluate accuracy of the CNN 904. K-fold cross-validation uses a single parameter "K" that refers the number of groups that a given sample dataset can be randomly split into. K-fold cross-validation can estimate the skill of the CNN 904 on unseen data, e.g. estimating how the CNN 904 is expected to perform in general when used to make predictions on data not used during training. In one or more embodiments, K=10, but other K, e.g. 5, 15, or 20, can be chosen. For example, a K value can be chosen that evenly splits the data set into groups have the same number of samples. In one or more embodiments, a single subsample is retained as validation data for testing the CNN 904, and the remaining K−1 subsamples are used as training data. Other types of cross-validations can be used, e.g. leave-p-out cross-validation, leave-one-out cross-validation (equivalent to K-fold cross-validation where the number of observations equals K), holdout cross-validation, Monte Carlo cross-validation, or nested cross-validation (e.g. k*1-fold cross-validation), or the like.

During training the sample dataset can be split from the training database 902 into a training set containing training data, a test set containing test data, and a validation set containing validation data. To avoid over-fitting to the training set, the training can be stopped if there is no improvement for a validation set for 3 consecutive epochs. An "epoch" is a single iteration over the entire training set, i.e. one pass through all the training data. For example, for a training set of size d and a mini-batch size b, then an epoch would be equivalent to d/b model updates. In one or more embodiments, the training is complete when the error in the validation data is decreasing, when the CNN 904 performs well on the training data, and when the CNN 904 performs well on the test data. In one or more embodiments, the test data is not used for training of the CNN 904.

The flowcharts herein are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more computer-readable media (e.g. computer-readable media 128 in FIG. 1). Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Figure 10:
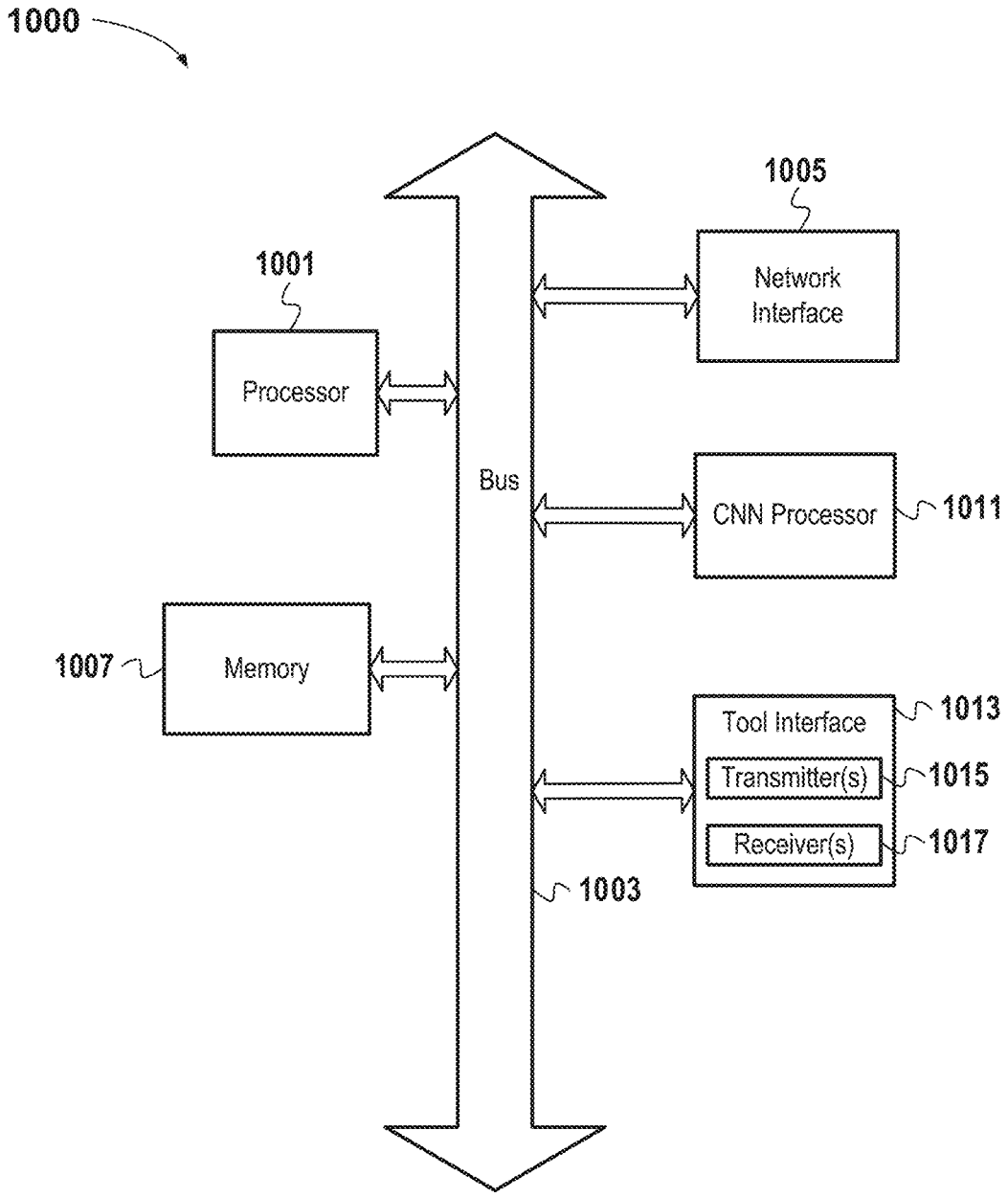
FIG. 10 depicts an example computer system with functionality and/or one or more processors for carrying out one or more of the methods described above, according to one or more embodiments.

FIG. 10 depicts an example computer system 1000 with functionality and/or one or more processors for carrying out one or more of the methods described above, according to one or more embodiments. The computer system includes a processor 1001 (possibly including multiple processors, multiple cores, multiple nodes, and/or implementing multithreading, etc.) and memory 1007. The memory 1007 may be system memory or any one or more of the above already described possible realizations of machine-readable media. The computer system also includes a bus 1003 and a network interface 1005. The system communicates via transmissions to and/or from remote devices via the network interface 1005 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.). The system also includes CNN processor 1011 and a tool interface 1013. The CNN processor 1011 can perform one or operations to train the CNN and to produce one or more processed images based on response images fed thereto according to any of the embodiments described above. The tool interface 1013 includes one or more transmitter interfaces 1015 and one or more receiver interfaces 1017. A machine-readable medium having program code executable by the processor 1001 can initiate measurements of the multiple nested tubulars (as described above) via the tool interface 1013. For example, program code can initiate transmission of an electromagnetic signal via one or more transmitters via the one or more transmitter interfaces 1015 and can initiate measurements via one or more receivers via the receiver interface 1017. Any one of the previously described functionalities may be partially (or entirely) implemented in hardware and/or on the processor 1001. For example, the functionality may be implemented with an application specific integrated circuit, in logic implemented in the processor 1001, in a co-processor on a peripheral device or card, etc. Further, realizations may include fewer or additional components not illustrated in FIG. 10 (e.g., video cards, audio cards, additional network interfaces, peripheral devices, etc.). The processor 1001 and the network interface 1005 are coupled to the bus 1003. Although illustrated as being coupled to the bus 1003, the memory 1007 may be coupled to the processor 1001.

While the aspects of the disclosure are described with reference to various implementations and exploitations, it will be understood that these aspects are illustrative and that the scope of the claims is not limited to them. In general, techniques for training and operating neural networks as described herein, such as embodiments of DNNs and CNNs described above, may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "up-hole," "upstream," or other like terms shall be construed as generally from the formation toward the surface, e.g., toward wellhead 14 in FIG. 1, or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed. As used herein, the term "or" is inclusive unless otherwise explicitly noted. Thus, the phrase "at least one of A, B, or C" is satisfied by any element from the set {A, B, C} or any combination thereof, including multiples of any element.

EXAMPLE EMBODIMENTS

Numerous examples are provided herein to enhance understanding of the present disclosure. A specific set of example embodiments are provided as follows:

Example A: A method for inspecting tubular integrity comprising: conveying an electromagnetic pipe inspection tool inside an innermost tubular of multiple nested tubulars, wherein the electromagnetic pipe inspection tool has one or more transmitters and one or more receivers; taking measurements of the multiple nested tubulars with the electromagnetic pipe inspection tool; arranging the measurements into a response image representative of a tool response to tubular integrity properties of the multiple nested tubulars; and feeding the response image to a pre-trained deep neural network (DNN) to produce a processed image, wherein the DNN comprises at least one convolutional layer, and wherein the processed image comprises a representation of the tubular integrity property of each individual tubular of the multiple nested tubulars.

In one or more embodiments of Example A, taking measurements of the multiple nested tubulars with the electromagnetic pipe inspection tool comprises transmitting electromagnetic fields at one or more frequencies with the one or more transmitters; and measuring at least one of a real-part, an imaginary-part, an absolute, an amplitude, and a phase of a received signal at the one or more frequencies with the one or more receivers, optionally, wherein the one or more receivers comprise multiple receivers, wherein the one or more frequencies comprise multiple frequencies, wherein the response image comprises a two-dimensional (2D) representation of the tool response, wherein the measurements for each receiver of the multiple receivers and each frequency of the multiple frequencies form a log, and wherein logs from the multiple receivers and the multiple frequencies are juxtaposed to form a 2D response image. In one or more embodiments of Example A, taking measurements of the multiple nested tubulars with the electromagnetic pipe inspection tool comprises exciting the multiple nested tubulars with pulsed electromagnetic fields with the one or more transmitters and measuring a decay response of the pulsed electromagnetic fields in the time domain with the one or more receivers, optionally, wherein the one or more receivers comprise multiple receivers, wherein the decay response measured by the multiple receivers comprises multiple time samples with different time delays, wherein the response image comprises a 2D representation of the tool response, wherein the measurements for each receiver of the multiple receivers and each time sample of the multiple time samples form a log, and wherein logs from the multiple receivers and the multiple time samples are juxtaposed to form a 2D response image. In one or more embodiments of Example A, arranging the measurements into a response image comprises mapping each measurement at each depth to a log data point on a log for each receiver; and assigning a value to each pixel in the response image, wherein the value assigned is proportional to a percentage change of each log data point from a nominal value of that log data point. In one or more embodiments of Example A, the tubular integrity property comprises a cross-sectional thickness, a magnetic permeability, an electrical conductivity, or a combination thereof. In one or more embodiments of Example A, a value assigned to each pixel in the processed image is proportional to a percentage change of the tubular integrity property of each of the individual tubulars of the multiple nested tubulars from a nominal tubular integrity property of each of the individual tubulars of the multiple nested tubulars. In one or more embodiments of Example A, feeding the response image to the pre-trained DNN comprises splitting the response image into sections based on depth. In one or more embodiments of Example A, the pre-trained DNN further comprises at least one of a concatenation layer, a summation layer, a max pooling layer, an up-sampling layer, and a dense layer.

The method in Example A can further comprise training the DNN to provide the pre-trained DNN, wherein training the DNN comprises building a database by using at least one of measurements of known cases and simulation, wherein the database includes a plurality of samples, wherein each sample of the plurality of samples comprises a true image of the tubular integrity property of each of the individual tubulars of the multiple nested tubulars and a corresponding response image, and, optionally, wherein training the DNN further comprises finding optimum network parameters to minimize a misfit between output images produced by the DNN and corresponding true images according to an error metric.

In one or more embodiments of Example A, taking measurements of the multiple nested tubulars with the electromagnetic pipe inspection tool comprises taking azimuthal measurements of the multiple nested tubulars using the electromagnetic pipe inspection tool, and, optionally, at least one of the following (in any order): (1) wherein the response image comprises a three-dimensional (3D) representation of the tool response, and wherein a first dimension is depth, a second dimension is azimuth, and a third dimension is a juxtaposition of measurements from multiple receivers and one of multiple frequencies and multiple time samples of the decay response at a given depth point and angular direction; (2) wherein the processed image comprises a 3D representation of the tubular integrity property of each the individual tubulars of the multiple nested tubulars; or (3) wherein the convolutional layer comprises a convolutional filter, and wherein the convolutional filter is 3D filter.

Example B: One or more non-transitory computer-readable media comprising program code for inspecting tubular integrity, the program code to: initiate measurements of multiple nested tubulars with an electromagnetic pipe inspection tool conveyed inside an innermost tubular of the multiple nested tubulars; arrange the measurements into a response image representative of a tool response to tubular integrity properties of the multiple nested tubulars; and feed the response image to a pre-trained DNN to produce a processed image, wherein the database includes a plurality of samples, and wherein each sample of the plurality of samples comprises a true image of the tubular integrity property of each of the individual tubulars of the multiple nested tubulars and a corresponding response image. In one or more embodiments of Example B, the tubular integrity property comprises a cross-sectional thickness, a magnetic permeability, an electrical conductivity, or a combination thereof. In one or more embodiments of Example B, a value assigned to each pixel in the processed image is proportional to a percentage change of the tubular integrity property of each of the multiple nested tubulars from a nominal tubular integrity property of each of the multiple nested tubulars.

Example C: A system comprising: an electromagnetic pipe inspection tool disposed inside an innermost tubular of multiple nested tubulars; a pre-trained DNN comprising at least one convolutional layer; a processor; and a computer-readable medium having program code executable by the processor to: initiate measurements of the multiple nested tubulars with the electromagnetic pipe inspection tool conveyed inside the innermost tubular; arrange the measurements into a response image representative of a tool response to tubular integrity properties of the multiple nested tubulars; and feed the response image to the pre-trained DNN to produce a processed image, wherein the processed image comprises a representation of the tubular integrity property of each individual tubular of the multiple nested tubulars.

The invention claimed is:

1. A method for inspecting tubular integrity comprising:

conveying an electromagnetic pipe inspection tool inside an innermost tubular of multiple nested tubulars, wherein the electromagnetic pipe inspection tool has one or more transmitters and one or more receivers;

taking measurements of the multiple nested tubulars with the electromagnetic pipe inspection tool;

arranging data from the measurements into a response image representative of a tool response to tubular integrity properties of the multiple nested tubulars, without requiring inversion of the measurements;

feeding the response image to a pre-trained deep neural network (DNN) to produce a processed image, wherein the DNN comprises at least one convolutional layer, and wherein the processed image comprises a representation of the tubular integrity properties of each of the multiple nested tubulars; and determining, from the processed image, the presence of metal loss or corrosion in one or more locations within the multiple nested tubulars.

2. The method of claim 1, wherein taking measurements of the multiple nested tubulars with the electromagnetic pipe inspection tool comprises transmitting electromagnetic fields at one or more frequencies with the one or more transmitters; and measuring at least one of a real-part, an imaginary-part, an absolute, an amplitude, and a phase of a received signal at the one or more frequencies with the one or more receivers.

3. The method of claim 2, wherein the one or more receivers comprise multiple receivers, wherein the one or more frequencies comprise multiple frequencies, wherein the response image comprises a two-dimensional (2D) representation of the tool response, wherein the measurements for each receiver of the multiple receivers and each frequency of the multiple frequencies form a log, and wherein logs from the multiple receivers and the multiple frequencies are juxtaposed to form a 2D response image.

4. The method of claim 1, wherein the electromagnetic pipe inspection tool is a time domain eddy current tool, wherein taking measurements of the multiple nested tubulars with the electromagnetic pipe inspection tool comprises exciting the multiple nested tubulars with pulsed electromagnetic fields with the one or more transmitters; and measuring a decay response of the pulsed electromagnetic fields in the time domain with the one or more receivers.

5. The method of claim 4, wherein the one or more receivers comprise multiple receivers, wherein the decay response measured by the multiple receivers comprises multiple time samples with different time delays, wherein the response image comprises a 2D representation of the tool response, wherein the measurements for each receiver of the multiple receivers and each time sample of the multiple time samples form a log, and wherein logs from the multiple receivers and the multiple time samples are juxtaposed to form a 2D response image.

6. The method of claim 1, wherein arranging the measurements into a response image comprises mapping each measurement at each depth to a log data point on a log for each receiver; and assigning a value to each pixel in the response image, wherein the value assigned is proportional to a percentage change of each log data point from a nominal value of that log data point.

7. The method of claim 1, wherein the tubular integrity property comprises a cross-sectional thickness, a magnetic permeability, an electrical conductivity, or a combination thereof.

8. The method of claim 1, wherein a value assigned to each pixel in the processed image is proportional to a percentage change of the tubular integrity property of each of the individual tubulars of the multiple nested tubulars from a nominal tubular integrity property of each of the individual tubulars of the multiple nested tubulars.

9. The method of claim 1, wherein feeding the response image to the pre-trained DNN comprises splitting the response image into sections based on depth.

10. The method of claim 1, wherein the pre-trained DNN further comprises at least one of a concatenation layer, a summation layer, a max pooling layer, an up-sampling layer, and a dense layer.

11. The method of claim 1, further comprising training the DNN to provide the pre-trained DNN, wherein training the DNN comprises building a database by using at least one of measurements of known cases and simulation, wherein the database includes a plurality of samples, and wherein each sample of the plurality of samples comprises a true image of the tubular integrity property of each of the individual tubulars of the multiple nested tubulars and a corresponding response image.

12. The method of claim 11, wherein training the DNN further comprises finding optimum network parameters to minimize a misfit between output images produced by the DNN and corresponding true images according to an error metric.

13. The method of claim 1, wherein taking measurements of the multiple nested tubulars with the electromagnetic pipe inspection tool comprises taking non-azimuthal, omnidirectional measurements of the multiple nested tubulars using the electromagnetic pipe inspection tool, wherein the image represents a variable density log of multiple data measurements.

14. The method of claim 1, wherein taking measurements of the multiple nested tubulars with the electromagnetic pipe inspection tool comprises taking azimuthal measurements of the multiple nested tubulars using the electromagnetic pipe inspection tool, wherein the response image comprises a three-dimensional (3D) representation of the tool response, and wherein a first dimension is depth, a second dimension is azimuth, and a third dimension is a juxtaposition of measurements from multiple receivers and one of multiple frequencies and multiple time samples of the decay response at a given depth point and angular direction.

15. The method of claim 13, wherein the processed image comprises a 3D representation of the tubular integrity property of each the individual tubulars of the multiple nested tubulars.

16. The method of claim 13, wherein the convolutional layer comprises a convolutional filter, and wherein the convolutional filter is 3D filter.

17. One or more non-transitory computer-readable media comprising program code for inspecting tubular integrity, the program code comprising:

instructions to initiate measurements of multiple nested tubulars with an electromagnetic pipe inspection tool conveyed inside an innermost tubular of the multiple nested tubulars;

instructions to arrange data from the measurements into a response image representative of a tool response to tubular integrity properties of the multiple nested tubulars, without requiring inversion of the measurements;

instructions to feed the response image to a pre-trained DNN to produce a processed image, wherein the DNN comprises at least one convolutional layer, and wherein the processed image comprises a representation of the tubular integrity properties of each of the multiple nested tubulars; and instructions to determine, from the processed image, the presence of metal loss or corrosion in one or more locations within the multiple nested tubulars.

18. The computer-readable media of claim 17, wherein the tubular integrity property comprises a cross-sectional thickness, a magnetic permeability, an electrical conductivity, or a combination thereof.

19. The computer-readable media of claim 17, wherein a value assigned to each pixel in the processed image is proportional to a percentage change of the tubular integrity property of each of the multiple nested tubulars from a nominal tubular integrity property of each of the multiple nested tubulars.

20. A system comprising:

an electromagnetic pipe inspection tool disposed inside an innermost tubular of multiple nested tubulars;

a pre-trained DNN comprising at least one convolutional layer; a processor; and a computer-readable medium having program code executable by the processor to:

initiate measurements of the multiple nested tubulars with the electromagnetic pipe inspection tool conveyed inside the innermost tubular;

arrange data from the measurements into a response image representative of a tool response to tubular integrity properties of the multiple nested tubulars, without requiring inversion of the measurements;

feed the response image to the pre-trained DNN to produce a processed image, wherein the processed image comprises a representation of the tubular integrity property of each individual tubular of the multiple nested tubulars; and determine, from the processed image, the presence of metal loss or corrosion in one or more locations within the multiple nested tubulars.

* * * * *